US005694788A

United States Patent [19]

Shin

[11] Patent Number: 5,694,788

[45] Date of Patent: Dec. 9, 1997

[54] AIR FLOW SYSTEM OF A REFRIGERATING COMPARTMENT OF REFRIGERATOR

[75] Inventor: Jun-Chul Shin, Incheon, Rep. of Korea

[73] Assignee: Daewoo Electronics Co., Ltd., Seoul, Rep. of Korea

[21] Appl. No.: 715,229

[22] Filed: Sep. 18, 1996

[30] Foreign Application Priority Data

Sep. 18, 1995 [KR] Rep. of Korea ..... 95-30496

[51] Int. Cl.[6] ..... F25D 17/04

[52] U.S. Cl. ..... 62/407; 62/441

[58] Field of Search ..... 62/404, 407, 408, 62/413, 441, 444, 445, 452, 455, 150, 151

[56] References Cited

U.S. PATENT DOCUMENTS 4,704,874 11/1987 Thompson et al. ..... 62/408
5,433,086 7/1995 Cho et al. ..... 62/455

*Primary Examiner*—John M. Sollecito
*Attorney, Agent, or Firm*—Beveridge, DeGrandi, Weilacher & Young LLP

[57] ABSTRACT

A refrigerator having a chilled air circulation system in which the chilled air in a refrigerating compartment is exhausted through the upper portion and the lower portion of the refrigerating compartment, is disclosed. Inlets for directing the chilled air into the refrigerating compartment are formed at the side wall and the inner wall of the refrigerator. At the lower portion of the refrigerating compartment, a chilled air exhausting duct for exhausting the chilled air, is installed. The chilled air exhausted from the refrigerating compartment through the chilled air exhausting duct is directed through an air duct formed between an intermediate wall and an outer wall toward an attaching plate installed at the upper end portion of the air duct. The chilled air is primarily cooled by the attaching plate and secondarily cooled by the evaporator. Uniform cooling of the refrigerating compartment can be achieved and the cooling efficiency of the evaporator can be increased.

4 Claims, 3 Drawing Sheets

AIR FLOW SYSTEM OF A REFRIGERATING COMPARTMENT OF REFRIGERATOR

BACKGROUND OF THE INVENTION

1. Field of the Invention

The present invention relates to a refrigerator, and more particularly to a chilled air flow system of a refrigerating compartment of a refrigerator.

2. Description of the Prior Art

Generally, a refrigerator is an apparatus for storing various foodstuffs in either a frozen or a refrigerated condition to extend the freshness of the foodstuffs for a long time. Such a refrigerator includes two cooling sections, one of which is a direct cooling type. That is, an evaporator used in a refrigerating cycle is installed in a food storage space and a direct heat-exchange is effectively achieved. The other type of the cooling section is an indirect cooling type, that is, an evaporator is mounted in an air passage remote from the food storage space. The air is heat-exchanged by the evaporator, and then the heat-exchanged air is directed to the food storage space by a fan.

The above described refrigerator commonly is provided with a freezing compartment and a refrigerating compartment located below the freezing compartment. Further, the refrigerating compartment is provided with a separate space having a temperature different from that of the main refrigerating compartment. This separated compartment is called a "vegetable storage area" or a "chilled compartment" for storing meats, etc. In these spaces, the foodstuffs can be individually stored in accordance with the desired conditions. On the front face of both the freezing compartment and the refrigerating compartment doors are installed so that foodstuffs can be placed in or removed from the freezing compartment and the refrigerating compartment.

In the above-described refrigerator, in order to store the foodstuffs with the desired conditions, that is, in order to maintain each compartment at a predetermined temperature, the heat-exchanged chilled air is conducted into the inner portion of each compartment by the fan. The chilled air exhausted from the compartments flows along the air passages.

The passages are disclosed in U.S. Pat. No. 4,704,874 issued to Thomson et al on Nov. 10, 1987 with the title of "Household refrigerator air flow system", in U.S. Pat. No. 5,388,427 issued to Sun G. Lee on Feb. 14, 1995 with the title of "Refrigerator with kimchi compartment" and in U.S. Pat. No. 5,433,086 issued to Cho et al on Jul. 18, 1995 and assigned to the assignee of the present invention with the title of "Refrigerator having independent temperature control of plural compartment".

FIG. 1 illustrates the conventional refrigerator disclosed in Thomson et al, Cho et al and Lee. As shown in the drawing, the conventional refrigerator includes a freezing compartment 10, a refrigerating compartment 30 which is separated from freezing compartment 10 by a partition 20 and located under freezing compartment 10, an evaporator 40 installed between freezing compartment 10 and an outer wall for cooling the air and removing the humidity contained in the air to generate a chilled air, a fan 50 positioned above evaporator 40 for directing the chilled air into freezing compartment 10 and refrigerating compartment 30, a main air duct 60 formed between evaporator 40 and the outer wall for providing a passage for the chilled air flow into refrigerating compartment 30 by fan 50, a first air duct 62 formed between freezing compartment 10 and partition 30 for the chilled air exhausted from freezing compartment 10 to flow to evaporator 40, a second air duct 64 formed between partition 20 and refrigerating compartment 30 for conducting the chilled air exhausted from refrigerator 30 to evaporator 40, and a third air duct 66, in which the chilled air having respectively flown along first duct 62 and second duct 64 is mixed, for providing a passage for the mixed chilled air to flow toward evaporator 40.

The chilled air generated by evaporator 40 is directed into freezing compartment 10 and refrigerating compartment 30 by fan 50. The chilled air directed into freezing and refrigerating compartments 10 and 30 cools freezing and refrigerating compartments 10 and 30, and then flows to first air duct 62 through a first chilled air outlet 12 formed at the bottom portion of freezing compartment 10. Meanwhile, the chilled air directed into refrigerating compartment 30 through an inlet 34 formed at the rear portion of refrigerating compartment 30 cools refrigerating compartment 30 and flows to second air duct 64 through a second chilled air outlet 32 formed at the upper portion of refrigerating compartment 30. The chilled airs from first and second air ducts 62 and 64 are mixed at third air duct 66 and the chilled air flows into evaporator 40 to be cooled again by evaporator 40. At this time, the humidity contained in the air is transformed into a layer of frost attached to evaporator 40. The layer of frost is transformed into water by a heater 68 installed in third air duct 66 and then the water is exhausted through a water outlet 69 formed at the bottom portion of third air duct 66.

The structure of the freezing compartment and the refrigerating compartment of the refrigerator for circulating the chilled air will be described briefly with reference to FIG. 1 below.

In the above-described refrigerator, the chilled air generated by evaporator 40 is circulated in the inner portions of freezing compartment 10 and refrigerating compartment 30, first, second and third air ducts 62, 64 and 66, and evaporator 40 by fan 50 to cool freezing compartment 10 and refrigerating compartment 30.

For cooling refrigerating compartment 30, the chilled air is directed into refrigerating compartment 30 through main duct 60 by fan 50 and is exhausted from refrigerating compartment 30 through second outlet 32 formed at the upper portion of refrigerating compartment 30. The chilled air exhausted from refrigerating compartment 30 is conducted through second air duct 64 formed between partition 20 and refrigerating compartment 30 and then is mixed with the chilled air exhausted from freezing compartment 10 at third air duct 66. The chilled air exhausted from freezing compartment 10 and refrigerating compartment 30 is cooled again by evaporator 40.

However, since chilled air inlet 34 and second chilled air outlet 32 are formed at the upper portion of refrigerating compartment 30, the chilled air directed into refrigerating compartment 30 through chilled air inlet 34 is rapidly exhausted through second chilled air outlet 32. According to this chilled air circulation system in refrigerating compartment 30, the temperature in refrigerating compartment 30 becomes partially different. For example, the temperature at the upper portion of refrigerating compartment 30 is relatively low. That is, since chilled air inlet 34 and second chilled air outlet 32 are formed at the upper portion of refrigerating compartment 30, the above-described chilled air circulation occurs. Therefore, the inner portion of refrigerating compartment 30 can not be cooled uniformly.

SUMMARY OF THE INVENTION

Accordingly, it is an object of the present invention to provide a refrigerator having a refrigerating compartment of which the inner portion can be cooled uniformly.

To accomplish the object of the present invention, there is provided a refrigerator comprising:

a freezing compartment;

an evaporator positioned between the freezing compartment and an outer wall, for cooling an air and generating a chilled air;

a refrigerating compartment having an upper plate, a side wall, an inner wall and a base plate, and forming a first air duct with the freezing compartment for exhausting the chilled air from the freezing compartment and the refrigerating compartment;

a fan for directing the chilled air generated by the evaporator into the freezing compartment and the refrigerating compartment;

an intermediate wall for forming a second air duct with the inner wall for conducting the chilled air exhausted from the refrigerating compartment, and for forming a main air duct with the outer wall for directing the chilled air into the refrigerating compartment; and a chilled air exhausting duct installed on an upper portion of the base plate of the refrigerating compartment, one end portion of the chilled air exhausting duct being connected with the second air duct for exhausting the chilled air from the refrigerating compartment.

In the first air duct, a partition is formed. The chilled air exhausted from the freezing compartment is directed through a space formed between the upper portion of the partition and the freezing compartment, and the chilled air exhausted from the refrigerating compartment is directed through a space formed between the lower portion of the partition and the upper plate of the refrigerating compartment. Heat exchange between the lower portion of the partition and the chill air exhausted from the refrigerating compartment occurs that lowers the temperature of the chilled air and transforms the humidity contained in the chilled air into a layer of frost. At the end portion of the partition, the chilled air exhausted from the freezing compartment and the chilled air exhausted from the refrigerating compartment are mixed and directed to the evaporator.

Chilled air inlets are formed at the side wall and the inner wall of the refrigerating compartment for the chilled air passed through the main air duct to flow into the refrigerating compartment. The chilled air directed into the refrigerating compartment through the chilled air inlets cools the inner portion of the refrigerating compartment, and then it is exhausted through the first air duct and the second air duct.

The chilled air exhausting duct connected with the second air duct is installed at the bottom portion of the refrigerating compartment. The leading edge of the chilled air exhausting duct is closed and an end portion thereof is connected with the second air duct. The chilled air exhausting duct is provided with a plurality of exhausting pores.

An attaching plate is vertically installed at the upper end portion of the second air duct. The attaching plate is connected with the upper plate of the refrigerating compartment and formes a water outlet with the upper plate. The attaching plate is made from a metal and has a plurality of pores. The chilled air exhausted from the refrigerating compartment through the second air duct looses heat through the attaching plate. The humidity contained in the chilled air is transformed into a layer of frost attached to the attaching plate.

Below the evaporator, a heater for removing the frost attached to the evaporator and the attaching plate is installed. The frost on the evaporator and the attaching plate is transformed into water by the heater and the phase changed water is drained off through the water outlet.

In the refrigerator according to the present invention, the chilled air in the refrigerating compartment can be exhausted through the upper portion and the lower portion of the refrigerating compartment. Accordingly, a uniform cooling of the inner portion of the refrigerating compartment can be achieved. Further, since the attaching plate is vertically installed, the water obtained at the attaching plate can be advantageously exhausted through the water outlet.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Hereinafter, the constituting elements and the operation principles of the refrigerator according to an embodiment of the present invention will be explained in more detail with reference to the accompanying drawings.

Figure 1:
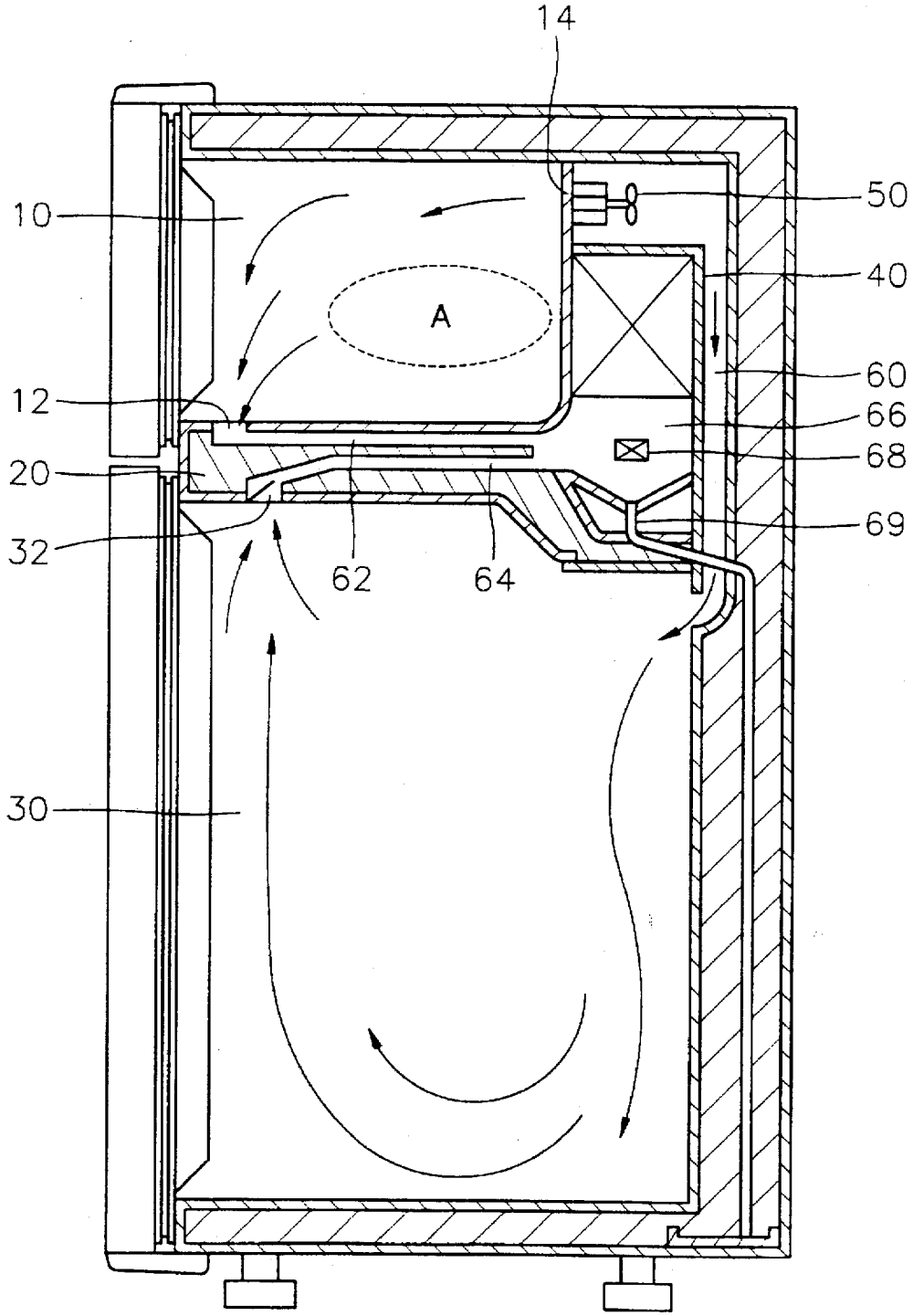
FIG. 1 (PRIOR ART)
FIG. 1 is a cross-sectional view of the conventional refrigerator for showing the circulation system of a chilled air.
Figure 2:
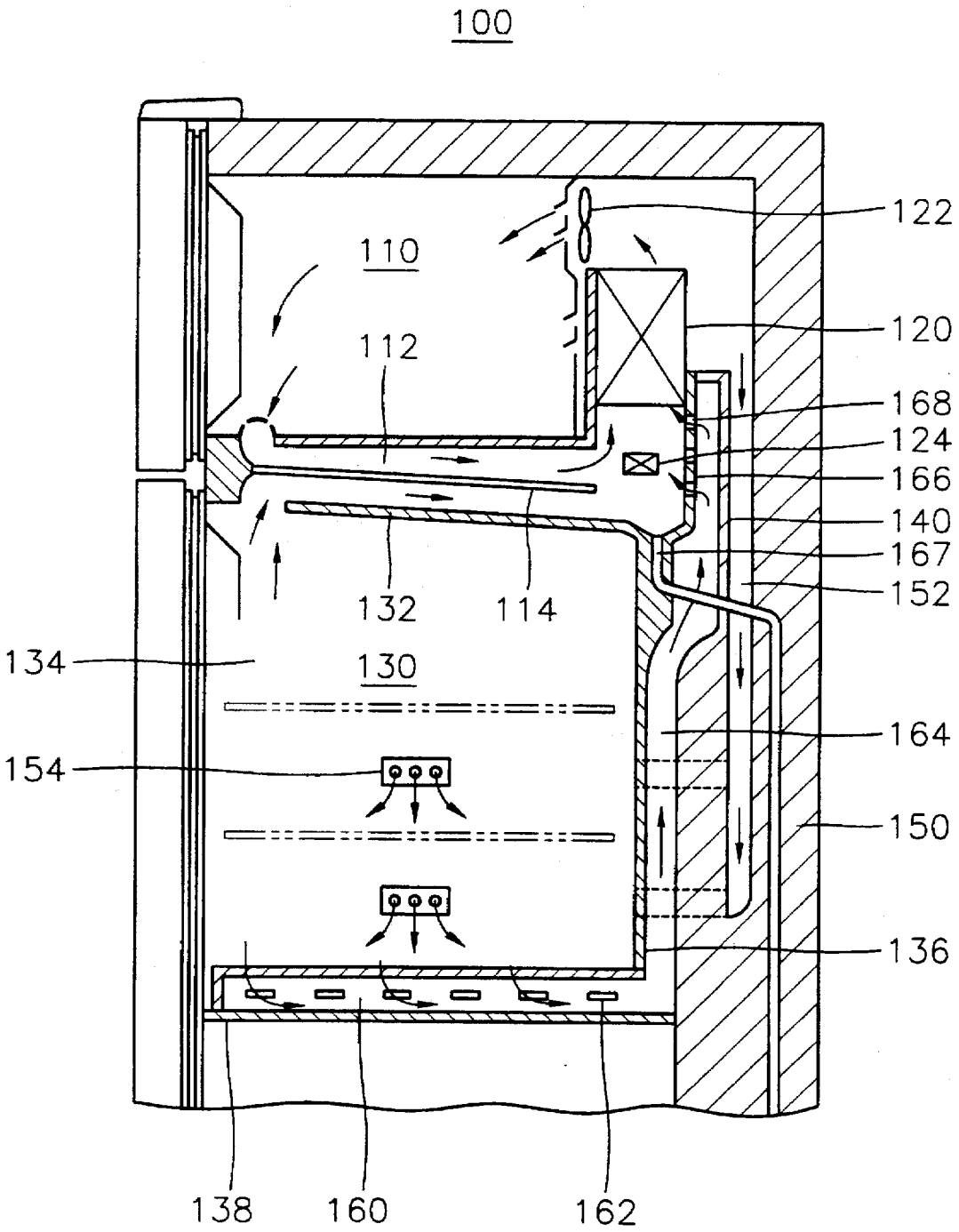
FIG. 2 is a cross-sectional view of a refrigerator according to the present invention for showing the circulation system of a chilled air.

FIG. 2 is a cross-sectional view of a refrigerator 100 according to a preferred embodiment of the present invention. As shown in FIG. 2, refrigerator 100 according to a preferred embodiment of the present invention is provided with a freezing compartment 110, an evaporator 120 positioned between freezing compartment 110 and an outer wall 150 for cooling air and generating a chilled air, and a refrigerating compartment 130 including an upper plate 132, a side wall 134, an inner wall 136 and a base plate 138.

Refrigerating compartment 130 is positioned below freezing compartment 110 and forms a first air duct 112 with freezing compartment 110, for exhausting the chilled air from freezing compartment 110 and refrigerating compartment 130. A partition 114 is formed in first air duct 112. Partition 114 separates the chilled air exhausted from freezing compartment 110 from the chilled air exhausted from refrigerating compartment 130. That is, the chilled air exhausted from freezing compartment 110 is directed into a space formed between the upper portion of partition 114 and freezing compartment 110, while the chilled air exhausted from refrigerating compartment 130 is directed into a space formed between the lower portion of partition 114 and upper plate 132 of refrigerating compartment 130. Heat exchange occurs between the lower portion of partition 114 with the chilled air exhausted from refrigerating compartment 130 and the temperature of the chilled air is lowered. Then, the humidity contained in the chilled air is transformed into a layer of frost attached to partition 114. The chilled airs exhausted from freezing compartment 110 and refrigerating compartment 130 are mixed at the end portion of partition 114, and the mixed air is directed to evaporator 120 and is cooled again by evaporator 120.

The chilled air generated by evaporator 120 starts to flow by a fan 122 installed above evaporator 120. The chilled air is directed into freezing compartment 110 and refrigerating compartment 130 by fan 122.

An intermediate wall 140 made from an insulating material is provided between evaporator 120 and outer wall 150. Intermediate wall 140 and outer wall 150 form a main air duct 152 for conducting the chilled air toward refrigerating compartment 130 by fan 122. Main air duct 152 is connected with a chilled air inlet 154 formed between side wall 134 and inner wall 136 of refrigerator 130.

The chilled air directed into refrigerating compartment 130 through chilled air inlet 154 circulates inside the inner portion of refrigerating compartment 130 to cool refrigerating compartment 130. Then, the chilled air is exhausted out through first air duct 112 and through a chilled air exhausting duct 160 installed at the upper portion of base plate 138.

Figure 3:
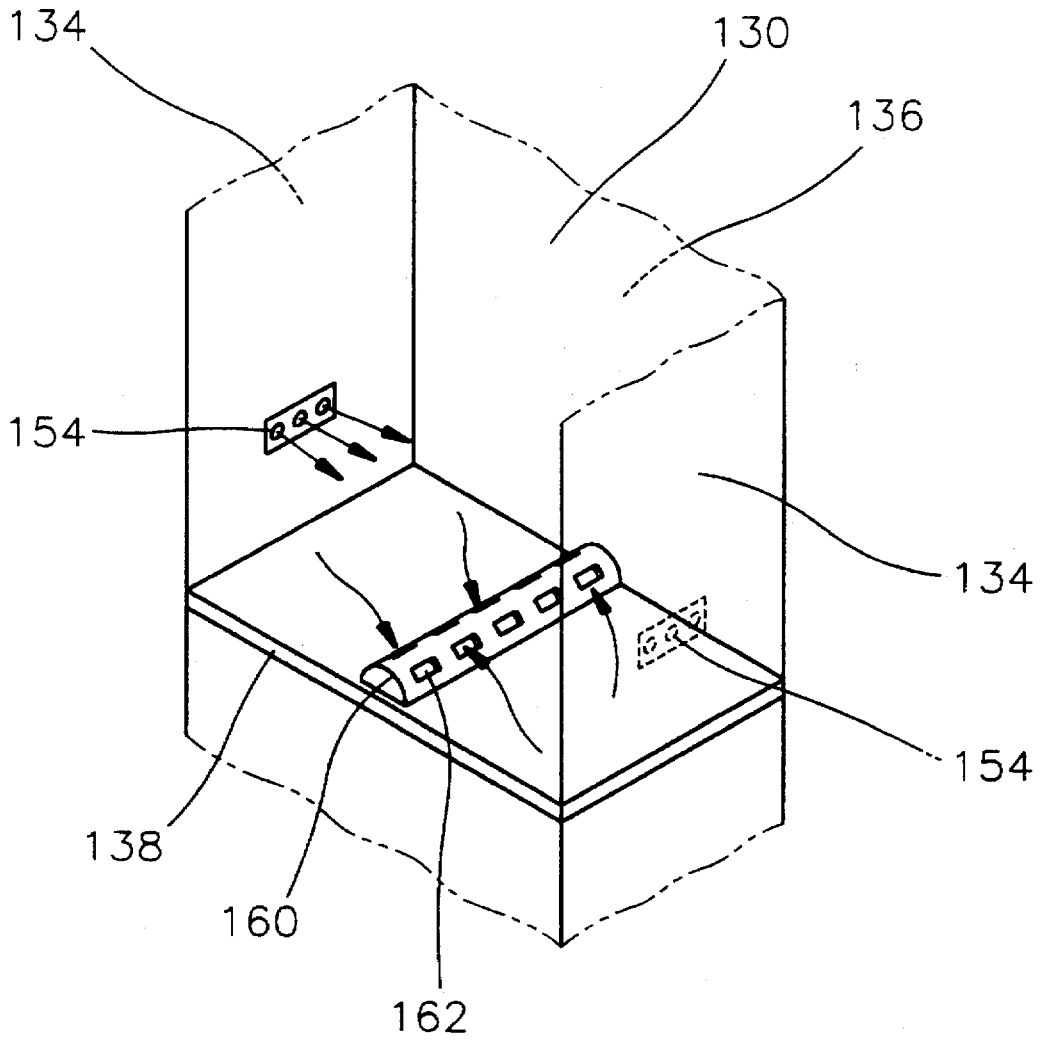
FIG. 3 is a partial perspective view of a chilled air exhausting duct installed in the refrigerating compartment of FIG. 2.

Chilled air exhausting duct 160 is made from a plastic material as illustrated in FIG. 3, has a semi-cylindrical shape and has a plurality of chilled air outlets 162 for exhausting the chilled air from refrigerating compartment 130. The leading edge of chilled air exhausting duct 160 is closed and the other end portion thereof is opened and connected with inner wall 136 for directing the chilled air toward evaporator 120. A second air duct 164 is formed between inner wall 136 and intermediate wall 140 for the flow of the chilled air exhausted through chilled air exhausting duct 160 toward evaporator 120.

At the upper end portion of second air duct 164, an attaching plate 166 having a plurality of pores 168 is vertically installed. Attaching plate 166 is made from a metal, preferably from aluminum and is connected with upper plate 132 of refrigerating compartment 130. The lower end portion of attaching plate 166 forms a water outlet 167 with upper plate 132.

The chilled air provided through second air duct 164 passes through pores 168 formed in attaching plate 166, and a heat exchange between the chilled air and attaching plate 166 occurs. At this time, the temperature of the chilled air is primarily lowered and the humidity contained in the chilled air is primarily removed by being transformed into frost attached to attaching plate 166. The chilled air conducted through second air duct 164 is mixed with the chilled air exhausted from refrigerating compartment 130 through first air duct 112 and the chilled air exhausted from freezing compartment 110. The mixed air is directed to evaporator 120. The mixed chilled air is secondarily cooled by evaporator 120. At this time, the temperature of the chilled air is lowered further and the humidity contained in the chilled air is transformed into a layer of frost attached to evaporator 120.

A heater 124 for removing the frost on evaporator 120 and attaching plate 166 is installed below evaporator 120 and in front of attaching plate 166. The frost is transformed into water by heater 124 and the phase changed water is drained off through water outlet 167.

The chilled air circulation process of refrigerator 100 according to a preferred embodiment of the present invention will be described below.

First, the chilled air generated by evaporator 120 is directed into freezing compartment 110 by fan 122 installed above evaporator 120, and is directed into refrigerating compartment 130 through main air duct 152 and chilled air inlet 154. The chilled air directed into refrigerating compartment 130 circulates in refrigerating compartment 130 and cools the inner portion of refrigerating compartment 130. After then, the chilled air is exhausted toward the upper portion of refrigerating compartment 130 through first air duct 112, and toward the lower portion of refrigerating compartment 130 through chilled air exhausting duct 160 and second air duct 164.

The chilled air exhausted through first air duct 112 is primarily cooled by partition 114, while the chilled air exhausted through chilled air exhausting duct 160 and second air duct 164 is primarily cooled by attaching plate 166. The chilled air from freezing compartment 110 and the chilled air exhausted through first air duct 112 and second air duct 164 are mixed near partition 114, and the mixed air is secondarily cooled by evaporator 120. The frost formed on attaching plate 166 and evaporator 120 is transformed into water by heater 124 and drained off through water outlet 167.

In the refrigerator of the present invention, the chilled air directed into the refrigerating compartment uniformly circulates and cools the inner portion of the refrigerating compartment. Further, the cooling efficiency of the evaporator can be increased by primarily cooling the chilled air using the partition and the attaching plate. And by vertically installing the attaching plate, the water obtained by the heater can be effectively exhausted.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a freezing compartment;

an evaporator positioned between said freezing compartment and an outer wall, for cooling an air and generating a chilled air;

a refrigerating compartment having an upper plate, a side wall, an inner wall and a base plate, and forming a first air duct with said freezing compartment for exhausting said chilled air from said freezing compartment and said refrigerating compartment;

a partition formed in said first air duct, said chilled air exhausted from said freezing compartment being directed through a space between an upper portion of said partition and said freezing compartment, and said chilled air exhausted from said refrigerating compartment being directed through a space between a lower portion of said partition and said upper plate of said refrigerating compartment;

a fan for directing said chilled air generated by said evaporator into said freezing compartment and said refrigerating compartment;

an intermediate wall for forming a second air duct with said inner wall for conducting said chilled air exhausted from said refrigerating compartment, and for forming a main air duct with said outer wall for directing said chilled air into said refrigerating compartment;

a chilled air exhausting duct installed on an upper portion of said base plate of said refrigerating compartment, one end portion of said chilled air exhausting duct being connected with said second air duct for exhausting said chilled air from said refrigerating compartment;

a metal attaching plate installed at an upper end portion of said second air duct and provided with a plurality of pores, for primarily cooling said chilled air flowing through said second air duct;

a heater installed below said evaporator, for transforming a layer of frost attached to said evaporator and said attaching plate into water; and chilled air inlets formed at said side wall and said inner wall of said refrigerating compartment, for directing said chilled air from said main air duct into said refrigerating compartment.

2. A refrigerator as claimed in claim 1, wherein a leading edge of said chilled air exhausting duct is closed and the other end portion thereof is connected with a lower end portion of said inner wall, said chilled air exhausting duct being provided with a plurality of exhausting pores and being semi-cylindrical shape.

3. A refrigerator as claimed in claim 1, wherein said attaching plate is made from aluminum.

4. A refrigerator as claimed in claim 1, wherein said intermediate wall is made from an insulating material.

* * * * *